US007101265B1

(12) United States Patent
Schur et al.

(10) Patent No.: US 7,101,265 B1
(45) Date of Patent: Sep. 5, 2006

(54) UNIVERSAL IMPROVED PARTICULATE MATTER DELIVERY DEVICE

(75) Inventors: Henry B. Schur, Hallandale, FL (US); John E. Trafton, Hallandale, FL (US)

(73) Assignee: Red Mountain, Inc., Fort Lauderdale, FL (US)

( * ) Notice: Subject to any disclaimer, the term of this patent is extended or adjusted under 35 U.S.C. 154(b) by 0 days.

(21) Appl. No.: 09/477,305

(22) Filed: Jan. 4, 2000

Related U.S. Application Data

(63) Continuation-in-part of application No. 09/360,793, filed on Jul. 26, 1999, and a continuation-in-part of application No. 08/863,857, filed on May 27, 1997, now Pat. No. 6,004,191, and a continuation-in-part of application No. 08/746,737, filed on Nov. 15, 1996, now abandoned, and a continuation-in-part of application No. 08/517,379, filed on Aug. 21, 1995, now Pat. No. 5,839,946.

(51) Int. Cl.
*B24C 5/04* (2006.01)

(52) U.S. Cl. ..... 451/90; 451/101

(58) Field of Classification Search ..... 451/102, 451/101, 90, 38, 99, 39
See application file for complete search history.

(56) References Cited

U.S. PATENT DOCUMENTS 2,441,441 A * 5/1948 Paasche ..... 451/90
2,696,049 A * 12/1954 Black ..... 451/101
2,725,684 A * 12/1955 Crowe ..... 451/90
3,631,631 A * 1/1972 Greenstein ..... 451/90
4,475,370 A * 10/1984 Stark et al. ..... 451/89
4,941,298 A * 7/1990 Fernwood et al. ..... 451/99
5,123,206 A * 6/1992 Woodson ..... 451/39
5,261,459 A * 11/1993 Atkinson et al. ..... 137/846
5,839,946 A * 11/1998 Hertz ..... 451/90
6,004,191 A * 12/1999 Schur et al. ..... 451/90

* cited by examiner

*Primary Examiner*—Robert A. Rose
(74) *Attorney, Agent, or Firm*—Robert J. Van Der Wall

(57) ABSTRACT

The present invention includes an apparatus for delivery of pressurized particulate matter against a surface or target to abrade, texture, sandblast, etch, erase, cut, penetrate, smooth, clean, polish, harden and/or deburr the surface or target. The invention is expected to be used in slightly different embodiments, both by dentists and oral hygienists to clean teeth, and by hobbyists, although numerous other uses are within the contemplation of the inventors. The dental embodiment features a prefilled, sealed, and disposable fluidizing chamber and cannula assembly that avoids contamination and which has been approved by the FDA for dental use. The general utility embodiment features a refillable fluidizing chamber and detachable cannula.

Included is a fluidizing chamber having a discharge end of an inlet tube that is disposed below or overlaps the intake end of the outlet tube such that the discharge of the inlet tube blows the particulate matter into the fluid above the intake end of the outlet tube, thereby suspending it therein, without clogging. The invention further provides for a duckbill check valve to prevent backflow of particulate matter when the chamber is disconnected from the pressurized fluid source or there is a drop in pressure from said source. Included with the general utility embodiment are a refill aperture and removable refill aperture plug to facilitate recharging the fluidizing chamber with particulate matter using a filling cartridge.

12 Claims, 3 Drawing Sheets

UNIVERSAL IMPROVED PARTICULATE MATTER DELIVERY DEVICE

This application is a Continuation-In-Part of U.S. application Ser. No. 08/863,857 filed on May 27, 1997, now U.S. Pat. No. 6,004,191, and Ser. No. 09/360,793 filed Jul. 26, 1999, with which it is co-pending and claims its filing date as to the common subject matter. All of these prior applications are incorporated by reference.

BACKGROUND OF THE INVENTION

Field of the Invention

This invention relates to delivery devices, and in particular to an all purpose or "universal" unit of an apparatus for delivery of pressurized particulate matter against a surface or target to abrade, texture, sandblast, etch, erase, cut, penetrate, smooth, clean, polish, harden and/or deburr the surface or target. The invention is expected to be used in slightly different embodiments, both by dentists and oral hygienists to clean teeth, and by hobbyists, although numerous other uses are within the contemplation of the inventors.

When used in the dental profession to clean teeth, the focus is particularly in preparation to adhere other materials to a tooth, such as a filling. The present invention is extremely well adapted to this application because it delivers a very effective cleaning capability, employing a particulate matter such as aluminum oxide, while at the same time having no effect on soft tissue such as the gums. The major aspect of the dental embodiment of present invention is a prefilled, sealed, and disposable fluidizing chamber and cannula assembly that avoids contamination and which has been approved by the FDA for dental use. When used for all other purposes, the invention is embodied in a refillable form having a detachable cannula.

BACKGROUND OF THE INVENTION

The present invention is a fluidizing chamber, cannula and duckbill check valve and swiveling quick disconnect assembly. It differs from the predecessor invention disclosed and claimed in the immediately prior parent application by, among other things, the elimination of the double function check valve feature, that was any one of at three possible configurations. The internal duckbill check valve is retained from one of those configurations as a single acting feature to prevent backflow of particulate matter when the chamber is disconnected from the pressurized fluid source or there is a drop in pressure from said source. Also added is a swiveling quick disconnect. The invention comes in two embodiments—one is refillable and includes detachable cannula, while the other includes a prefilled, sealed, and disposable fluidizing chamber with fixedly attached cannula that is disposed with the empty fluidizing chamber.

The duckbill valve is placed on the discharge end of the inlet tube disposed within the fluidizing chamber. It is made of a resiliently flexible material and formed with a bullet nose shape with a slit at the nose. The duckbill valve is normally closed due to the natural molded shape of the part and the shape memory of the material from which it is formed. In use the fluid pressure required to operate the valve is sufficiently strong to open the "jaws" of the slit allowing for full flow of the fluid. As the pressure is reduced or eliminated, the jaws naturally close as a result of the elastic memory of the material. This prevents backflow of the particulate matter.

Earlier designs of pressurized particulate matter delivery devices have demonstrated there can be difficulty with clogging in the fluidizing chamber and/or the delivery tube. The present invention is partially directed to an improved internal structure of the fluidizing chamber which produces effective fluidization without clogging.

The swiveling quick disconnect is intended to be in fluid communication with a pneumatic pressure line that is operated on and off by a control apparatus that may optionally be in the form of a foot pedal. When used in the dental profession, connection is to the pneumatic pressure line of a dental office pedestal. Since this control apparatus technology is well known, it is not disclosed and is referred to as conventional.

Another feature of the general utility (non-dental) use embodiment of the invention includes a disposable cannula that preferably includes a tapered nozzle (which may be really a disposable hypodermic needle) which can be detached from the refillable fluidizing chamber. Detachment is important because since the fluidizing chamber can be perpetually refilled. Therefore, the cannula will need to be replaced regularly, since the grit is abrasive and wears out the cannula more quickly than other components in the inventive assembly. Detachment also facilitates optional availability of a plurality of differing tips to accommodate differing grit sizes and different pressure in the fluidizing chamber for a variety of different uses. Also available are bent particle delivery cannula, which are furnished bent at a 45 degree angle or a 90 degree angle.

Examples of prior known devices include that described in U.S. Pat. No. 4,941,298 to Fernwood, which discloses a rear-reservoir micro sandblaster. The Fernwood patent has numerous problems including costly to dispose, special training for set up and use, and cannot deliver varying sizes of particles. Other known devices with similar problems are the Microetcher™ and the Handiblaster™ available from Mirage/Chameleon Dental Products, Inc.

SUMMARY OF THE INVENTION

The primary object of the present invention is to provide an all purpose or universal improved pressurized particulate matter delivery device that includes a fluidizing chamber, internal single acting duckbill valve, swiveling quick disconnect, and disposable cannula. The inventive device provides delivery of pressurized particulate matter against a surface or target to abrade, texture, sandblast, etch, erase, cut, penetrate, smooth, clean, polish, harden and/or deburr the surface or target.

Another important object of the present invention is to provide a particulate matter delivery device that includes an improved internal structure of the fluidizing chamber which produces effective fluidization without clogging.

One more important object of the present invention is to provide a particulate matter delivery device wherein the fluidizing chamber and cannula assembly is in series with a swiveling quick disconnect and includes an internal single acting duckbill valve to prevent backflow of particulate matter when disconnected from the pressurized fluid source or in the event of a drop in fluid pressure.

Another primary object of the present invention in a dental embodiment is to provide a particulate matter delivery device that includes an FDA approved prefilled, sealed, and disposable fluidizing chamber and fixedly connected cannula that avoids contamination. Prefilling, sealing, and disposability are key aspects to assurances that materials used in a patient's mouth are sanitary since the manufacturing facility has complete control over the sterility of the inventive device and the particulate matter with which it is charged in the manufacturing process.

Another object of the invention in a general utility use embodiment includes a refillable fluidizing chamber and a disposable cannula, preferably with a tapered nozzle. The cannula can be detached from the refillable fluidizing chamber, in part because the cannula will need to be replaced regularly, since the grit is abrasive and wears out the cannula more quickly than other components in the inventive assembly.

A related object of the invention is to facilitate interchangeable availability and use of a plurality of different cannula tips in the general untility embodiment to accommodate differing grit sizes and different pressure in the fluidizing chamber and to allow use of various bent particle delivery cannula, which are furnished straight, bent at a 45 degree angle or bent at a 90 degree angle.

A further object of this invention is to provide a device for delivery of a fluid particle stream using a cannula with a tapered nozzle to accelerate particle velocity.

An additional object of this invention is to provide a particulate matter delivery apparatus that is lightweight to facilitate convenient use by dental professionals, hobbyists or other users.

Another object of the invention is to employ a swiveling quick disconnect which allows easy rotation or swiveling 360 degrees about the pressure line that is especially advantageous for dental use in reaching all the myriad differently oriented surfaces on a patient's teeth.

A related object of the invention is to use a quick disconnect that readily facilitates refilling the fluidizing chamber with particulate matter in the general utility embodiment of the invention.

An additional object of this invention is to provide a particulate matter delivery apparatus that is very lightweight to make it easy for a dentist or oral hygienist to use.

One more object of the invention is to provide an effective, safe, sanitary, FDA approved, easy to use dental cleaning device that requires essentially no capital investment by the dentist because it employs a pneumatic pressure line already found on a dentist's pedestal, uses a check valve that weighs almost nothing, and a small lightweight fluidizing chamber and cannula assembly that is disposable.

Further objects and advantages of this invention will be apparent from the following detailed description of a presently preferred embodiment which is illustrated schematically in the accompanying drawings.

In accordance with a major aspect of the invention, there is provided an apparatus for delivery of pressurized particulate matter against a surface or target to abrade, texture, sandblast, etch, erase, cut, penetrate, smooth, clean, polish, harden and/or deburr the surface or target. One preferred embodiment thereof includes a refillable fluidizing chamber for mixing fluid and particulate matter together by suspending the latter in the former, and a detachable cannula tube having a particle accelerating tapered nozzle extending outside the fluidizing chamber, wherein the cannula tube delivers pressurized particulate matter from the fluidizing chamber to a surface or target at a high velocity.

In accordance with a second major aspect of the invention, there is provided a particulate matter delivery device that includes an FDA approved fluidizing chamber and cannula that avoids contamination because the fluidizing chamber is prefilled, sealed, and disposable, key aspects to assurances that materials used in a patient's mouth are sanitary since the manufacturing facility has complete control over the sterility of the inventive device and the particulate matter with which it is charged in the manufacturing process.

This embodiment includes a cannula nozzle cap which is used to protect and seal off the discharge orifice of the tapered nozzle of the cannula. Although available for this purpose any time the inventive particulate matter delivery device is not in use in either embodiment, the cannula nozzle cap is particularly appropriate to protect the sterility of the dental unit embodiment of the invention when in storage and shipment to the office of the dental professional. A related aspect of the invention is a barrel top recess shipping cap. It is for the purpose of sealing off the barrel end cap pressure aperture, especially during shipment of the prefilled, sealed, and disposable fluidizing chamber of the dental embodiment of the invention.

The fluidizing chamber incorporates a simple yet extremely effective internal structure to accomplish the suspension of the particulate matter in the fluid, usually a gaseous fluid such as air. It is merely comprised of a discharge end of an inlet tube that is disposed below the intake end of the cannula or overlaps it. The effect is that the discharge of the inlet tube blows the particulate matter into the fluid above the intake end of the cannula, thereby suspending it therein, without clogging.

The components of the fluidizing chamber structure are comprised of a tapered barrel, to which the cannula is connected, and a barrel end cap, to which the inlet tube is fixedly inserted. The barrel end cap is fixedly attached inside the top of the tapered barrel, above which is the barrel top recess for the insertion of an adapter.

The barrel end cap comes in two forms depending on whether it is in the dental disposable unit or the general utility refillable unit. The only difference is the presence of a refill aperture, which is threaded to accept a removable refill aperture plug in the general utility embodiment. This feature is absent from the dental embodiment which must remain sealed.

With the plug removed, the fluidizing chamber can be recharged with particulate matter using a filling cartridge, which is preferably equipped with a snap tip and a fill nozzle. This structure allows for the invention to be recharged with particulate matter. In order to accomplish this, it is first necessary to remove an adapter which is lightly press fitted into the barrel top recess above the barrel end cap. When the adapter is removed, the top of the refill aperture plug is exposed for removal, preferably using a conventional allen wrench in an allen wrench hex recess in the upper surface thereof.

The adapter is disposed between the fluidizing chamber and the quick disconnect end of a pressurized fluid source pressure line and used to removably maintain fluid communication between them. It includes a groove to removably capture the ball bearings in a conventional slip ring quick disconnect.

Another important aspect of the preferred embodiment is the single acting duckbill check valve at the distal end of the inlet tube. This is to prevent backflow of particulate matter when the fluidizing chamber is separated from the pressurized fluid source or in the event of a drop in fluid pressure.

A further feature of the invention is a disposable and replaceable cannula in the general utility embodiment of the invention which preferably includes tapered nozzle to accelerate the particulate matter as it exits from the cannula. The cannula may be conventional (really a disposable hypodermic needle). Regardless of its design detail, in the general utility unit it must be detachable from the refillable fluidizing chamber.

Detachment is important because the cannula will need to be replaced regularly, since the grit is abrasive, and wears out the cannula more quickly than other components in the inventive assembly given the fact that the fluidizing chamber can be refilled many times with this embodiment. Detachment also facilitates optional availability of a plurality of differing tips to accommodate differing grit sizes and different pressure in the fluidizing chamber. Also available are bent particle delivery cannula, which are furnished bent at a 45 degree angle or a 90 degree angle. The tapered aspect of the cannula acts as a particle accelerator because it increases the velocity of the particles exiting from the cannula discharge orifice.

The invention is designed to attach to a pressurized fluid source that is normally be a pneumatic pressure line that is usually operated on and off by a control apparatus that may optionally be in the form of a foot pedal. The fluidizing chamber and cannula assembly is lightweight and removably connected to the pressurized fluid source.

DESCRIPTION OF THE PREFERRED EMBODIMENTS

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
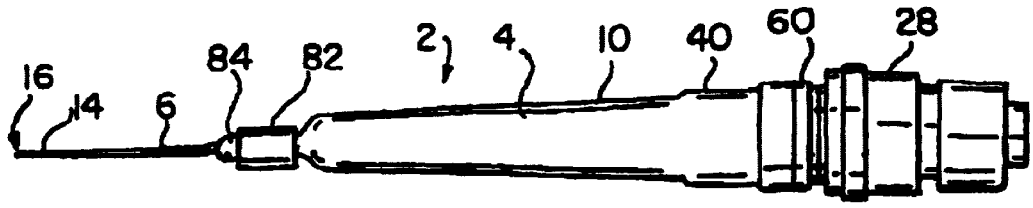
FIG. 1 is a plan view of the universal improved particulate matter delivery device in the general utility embodiment with a detachable cannula.

FIG. 1 is a plan view of the universal improved particulate matter delivery device 2 in the general utility embodiment having a fluidizing chamber 4 and detachable cannula 6. The fluidizing chamber 4 includes a tapered barrel 10 which has an enlarged barrel top end 40. Next to barrel top end 40 is adapter 60, which is removably locked to swiveling quick disconnect 28. Cannula 6 preferably includes a tapered nozzle 14 to accelerate particle velocity toward a target (not shown). Cannula 6 terminates, of course, with a discharge orifice 16. Because the cannula 6 is detachable, it includes a luer locking hub 84 which connects to a luer locking male adapter 82.

Figure 2:
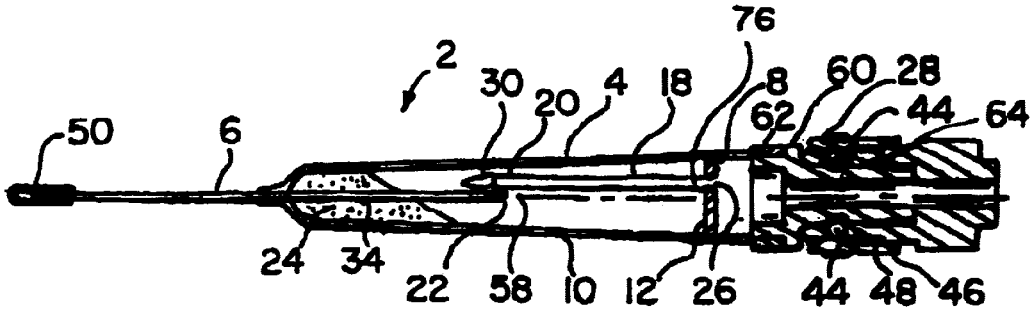
FIG. 2 is a cross-sectional view of the universal improved particulate matter delivery device in the disposable dental unit embodiment, showing the interior structure of the fluidizing chamber with duckbill valve, adapter inserted into the barrel top recess, and with the adapter removably locked into the swiveling quick disconnect.

FIG. 2 is a cross-sectional view of the universal improved particulate matter delivery device in the disposable dental unit embodiment, showing the interior structure of the fluidizing chamber 4 with duckbill check valve 30, adapter 60 flanged end 62 inserted into the barrel top recess 8, and with the adapter removably locked into the swiveling quick disconnect 28. Swiveling quick disconnect 28 includes ball bearings 44 which are removably locked into adapter groove 64.

Locking in this regard refers to axial locking to establish and maintain pressure communication between the pressurized fluid source (not shown) and the fluidizing chamber 4. However the swiveling function described in regard to the swiveling quick disconnect 28 occurs by reason of radial translation between the ball bearings 44 of swiveling quick disconnect 28 and adapter groove 64.

Disconnection and reconnection is achieved by moving axially sliding ring 46 against a biasing means, preferably a coil spring 48. This allows retraction of the ball bearings 44 from the adpater groove 64.

Inlet tube 18 having discharge end 20 is shown overlapping the intake end 22 of outlet tube 34 to achieve the suspension of particulate matter in fluid such as air. Since the particulate matter delivery device commercial unit 2, when in use, is usually held substantially erect with the cannula 6 generally below the fluidizing chamber 4, the particulate matter 24 will generally then be resting at the cannula end of the tapered barrel 10. It is for that reason that the above description refers to the internal structure of the fluidizing chamber 4 as having a discharge end 20 of inlet tube 18 that is disposed "below" the intake end 22 of the outlet tube 34. Cannula 6 may have its discharge orifice 16 protected, especially during shipment of the dental unit embodiment, with cannula nozzle cap 50.

In the general utility embodiment, cannula 6 may actually be a conventional disposable hypodermic needle having luer locking hub 84. See FIG. 3. Cannula 6 is removably attached to a conventional luer locking male adapter 82, which in turn is attached to threaded discharge end 92 of tapered barrel 10. Outlet tube 34 is held in barrel aperture 42 concentric with both threaded discharge end 92 and centerline 58 of tapered barrel 10. Elsewhere, barrel end cap 12 is shown fixedly attached to tapered barrel 10.

Figure 3:
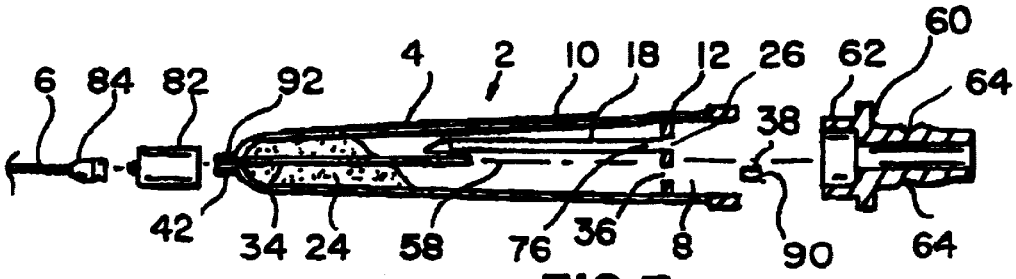
FIG. 3 is a cross sectional view of the universal improved particulate matter delivery device in the general utility unit embodiment with the adapter removed from the barrel top recess and showing the removable refill aperture plug removed from the refill aperture preparatory for recharging the fluidizing chamber with particulate mattter.

FIG. 3 is a cross sectional view of the universal improved particulate matter delivery device in the general utility unit embodiment with the adapter 60 removed from the barrel top recess 8. It shows the removable refill aperture plug 38 removed from the refill aperture 36 preparatory for recharging the fluidizing chamber 4 with particulate matter 24. The removable refill aperture plug 38 includes an allen wrench hex recess 90 to facilitate its removal from and replacement into the threaded refill aperture 36 in barrel end cap 12. Also seen are inlet tube intake 76 and threaded discharge end 92 of tapered barrel 10.

Therefore, in the general utility embodiment of the invention when the refillable fluidizing chamber 4 runs out of particulate matter 24, it takes only a few minutes to disconnect the tapered barrel 10 containing fluidizing chamber 4 from adapter 60, remove the refill aperture plug 38 from the refill aperture 36 in the barrel end cap 12, and refill the fluidizing chamber 4 of tapered barrel 10 with particulate matter 24. using filling cartridge 94. See FIG. 12. This may be facilitated by unlocking swiveling quick disconnect 28 from adapter 60 before removing adapter 60 from barrel top recess 8. See FIG. 2. Refilling is accomplished by employing filling cartridge 96 fill nozzle 98, which is placed in refill aperture 36 of barrel end cap 12. If the filling cartridge 96 has not been used previously, it may be opened using a snap off tip 96 on the fill nozzle 98. The refill aperture plug 38 is then reinserted into refill aperture 36, threaded in place and tightened using a conventional allen wrench (not shown) that is placed into allen wrench hex recess 90. Then, the flanged end 62 of adapter 60 can be reinserted into barrel top recess 8, and swiveling quick disconnect 28 relocked into adapter groove 64 if swiveling quick disconnect 28 was removed from adapter 60 before refilling was initiated.

Figure 4:
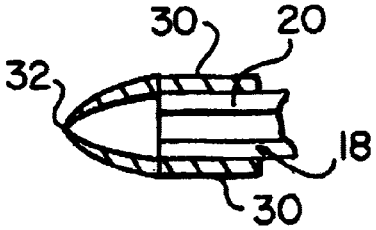
FIG. 4 is an enlarged broken cross-sectional view of the duckbill check valve disposed on the discharge end of the inlet tube.

FIG. 4 is an enlarged broken cross-sectional view of the duckbill check valve 30 disposed on the discharge end 20 of the inlet tube 18. Formed in the shape of the nose of a flattened bullet, a slit 32 is disposed at the intersection of the two sides. The duckbill check valve is made of a resiliently flexible material. The duckbill check valve 30 is normally closed due to the natural molded shape of the part and the shape memory of the material from which it is formed. In use the fluid pressure required to operate duckbill check valve 30 is sufficiently strong to open the "jaws" of the slit 32 allowing for full flow of the fluid. As the pressure is reduced or eliminated, the jaws naturally close as a result of the elastic memory of the material. This prevents backflow of the particulate matter 24.

Figure 5:
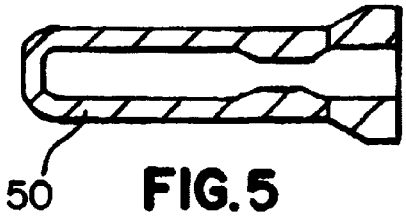
FIG. 5 is an enlarged cross-sectional view of the cannula nozzle cap.

FIG. 5 is an enlarged cross-sectional view of the cannula nozzle cap 50 which is used to protect and seal off the discharge orifice 16 of the tapered nozzle 14 of cannula 6. Although available for this purpose any time the inventive particulate matter delivery device is not in use, the cannula nozzle cap 50 is particularly appropriate to protect the sterility of the dental unit embodiment of the invention when in storage and shipment to the office of the dental professional.

Figure 6:
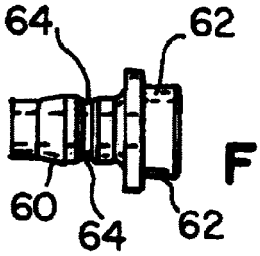
FIG. 6 is a side view of the adapter showing the flanged end which fits into the barrel top recess, and the groove into which the ball bearings of the swiveling quick disconnect are removably locked.

FIG. 6 is a side view of the adapter 60 showing the flanged end 62 which fits into the barrel top recess 8, and the adapter groove 64 into which the ball bearings 44 of the swiveling quick disconnect 28 are removably locked. See FIG. 2. While adapter 60 can be removed from barrel top recess 8 while still removably locked to swiveling quick disconnect 28, separating adapter 60 from quick disconnect 28 may facilitate handling the recharging of the fluidizing chamber 4 with particulate matter 24 by use of the refill aperture 36 and removable refill aperture plug 38 in barrel end cap 12 as best seen in FIG. 3.

Figure 7:
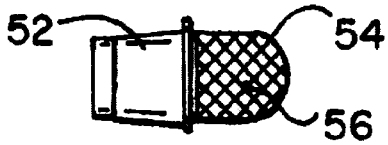
FIG. 7 is a side view of the barrel top recess shipping cap, which seals off the barrel end cap pressure aperture especially during shipment of the prefilled, sealed, and disposable fluidizing chamber of the dental embodiment of the invention.

FIG. 7 is a side view of the barrel top recess shipping cap 52, which seals off the barrel end cap pressure aperture 26 especially during shipment of the prefilled, sealed, and disposable fluidizing chamber 4 of the dental embodiment of the invention. Readily seen is finger tab 54 with nonslip surfaces 56 to allow the barrel top recess shipping cap 52 to be firmly grasped for removal from the barrel top recess 8.

Figure 8:
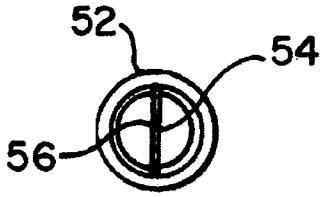
FIG. 8 is a top view of the barrel top recess shipping cap.

FIG. 8 is a top view of the barrel top recess shipping cap 52.

Figure 9:
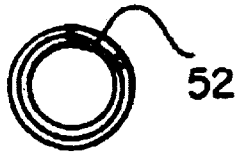
FIG. 9 is a bottom view of the barrel top recess shipping cap.

FIG. 9 is a bottom view of the barrel top recess shipping cap 52.

Figure 10:
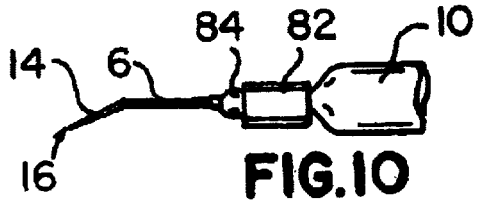
FIG. 10 shows a broken plan view of the cannula end of the barrel with a first alternative embodiment of the cannula in a forty-five degree bent configuration that may be preferred for certain applications or by some users of the invention.

FIG. 10 shows a broken plan view of the threaded discharge end 92 of the tapered barrel 10 of the general utility embodiment of the invention with a first alternative embodiment of the cannula 6 in a forty-five degree bent configuration that may be preferred for certain applications or by some users of the invention. Also seen are conventional luer locking male adapter 82, luer locking hub 84, tapered nozzle 14 and discharge orifice 16.

Figure 11:
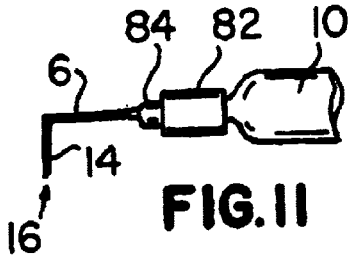
FIG. 11 shows a broken plan view of the cannula end of the barrel with a second alternative embodiment of the cannula in a ninety degree bent configuration that may be preferred for certain other applications or by other users of the invention.

FIG. 11 shows a broken plan view of the threaded discharge end 92 of the tapered barrel 10 of the general utility embodiment of the invention with a second alternative embodiment of the cannula in a ninety degree bent configuration that may be preferred for certain other applications or by other users of the invention. Other parts are shown as described in connection with FIG. 10.

Figure 12:
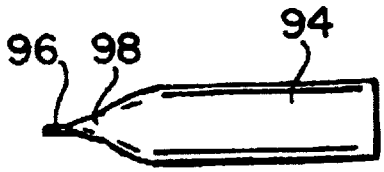
FIG. 12 is a miniature plan view of the filling cartridge.

FIG. 12 is a miniature plan view of the filling cartridge 94. It includes snap off tip 96 and fill nozzle 98, and it's function has been described in connection with FIG. 3 above.

While the above embodiments describe using particulate matter such as aluminum oxide in the chamber, other particles such as but not limited to sodium bicarbonate can be used. Further, the above embodiments can include a separate water line running through the interior chamber from a conventional outside waterline so that water under pressure can be sprayed onto the target while sodium bicarbonate or aluminum oxide is also used in combination.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended and their equivalents.

What is claimed is:

1. A universal improved particulate matter delivery apparatus having a fluidizing chamber for mixing fluid and particulate matter comprising:

an inlet tube connected to a pressurized fluid source and having a discharge end disposed within the fluidizing chamber;

a duckbill check valve disposed on the discharge end of the inlet tube to prevent backflow of particulate matter;

a outlet tube having an intake end disposed within the fluidizing chamber;

wherein the inlet tube discharge end and outlet tube intake end overlap each other; and a cannula in fluid communication with the outlet tube and having a discharge orifice disposed outside the fluidizing chamber.

2. The apparatus of claim 1 in which the fluidizing chamber and cannula are fixedly attached to each other to form a prefilled, sealed, and disposable fluidizing chamber and cannula assembly that minimizes contamination and maximizes sterility for dental applications.

3. The apparatus of claim 2 which further comprises:

a tapered barrel and barrel end cap fixedly attached to the tapered barrel forming the fluidizing chamber; and a pressure aperture in the barrel end cap.

4. The apparatus of claim 3 which further comprises a shipping cap to seal off the pressure aperture of the prefilled, sealed, and disposable fluidizing chamber.

5. The apparatus of claim 1 which further comprises a cannula cap to seal off the discharge orifice of the cannula.

6. The apparatus of claim 1 which further comprises:

a tapered barrel and barrel end cap fixedly attached to the tapered barrel forming the fluidizing chamber;

a particulate matter refill aperture in the barrel end cap; and a removable refill aperture plug to facilitate recharging the fluidizing chamber with particulate matter.

7. The apparatus of claim 6 in which the cannula is removably attached to the tapered barrel.

8. The apparatus of claim 1 in which the cannula includes a tapered nozzle.

9. The apparatus of claim 1 in which the cannula is bent.

10. The apparatus of claim 1 in which the particulate matter includes aluminum oxide.

11. The apparatus of claim 1 in which the particulate matter includes sodium bicarbonate.

12. The apparatus of claim 1 in which particulate matter disposed within the fluidizing chamber when exhausted from use can be recharged by a user.

* * * * *